US008074823B1

(12) United States Patent
Steidinger, III

(10) Patent No.: US 8,074,823 B1
(45) Date of Patent: Dec. 13, 2011

(54) VACUUM RELEASE DEVICE FOR ASSISTING REMOVAL OF PLASTIC BAGS FROM CONTAINERS

(76) Inventor: John H. Steidinger, III, Bethlehem, PA (US)

( * ) Notice: Subject to any disclaimer, the term of this patent is extended or adjusted under 35 U.S.C. 154(b) by 365 days.

(21) Appl. No.: 12/427,951

(22) Filed: Apr. 22, 2009

(51) Int. Cl.

| | |
|---|---|
| ***B65D 25/14*** | (2006.01) |
| ***B65D 35/14*** | (2006.01) |
| ***B65D 90/00*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 90/22*** | (2006.01) |
| ***B65D 6/40*** | (2006.01) |
| ***B65D 25/00*** | (2006.01) |
| ***B65D 90/36*** | (2006.01) |

(52) U.S. Cl. ..... 220/495.04; 220/495.06; 220/495.01; 220/669; 220/694; 220/745; 220/89.1; 220/908

(58) Field of Classification Search ..... 220/669, 220/495.01, 495.04, 495.06, 694, 745, 89.1, 220/908

See application file for complete search history.

(56) References Cited

U.S. PATENT DOCUMENTS

| | | | | |
|---|---|---|---|---|
| 3,334,621 | A * | 8/1967 | Britt | 126/299 R |
| 4,294,379 | A | 10/1981 | Bard | |
| 4,782,970 | A * | 11/1988 | Edwards | 209/636 |
| 5,170,906 | A | 12/1992 | Kochelek | |
| 5,375,732 | A | 12/1994 | Bowers et al. | |
| 5,492,241 | A * | 2/1996 | Barnett et al. | 220/694 |
| 6,015,063 | A | 1/2000 | Poliquin | |
| 6,474,495 | B1 | 11/2002 | Frei | |
| 6,594,876 | B1 | 7/2003 | Stastny | |
| 6,634,518 | B1 * | 10/2003 | Jones | 220/495.04 |
| 6,736,281 | B2 | 5/2004 | Joseph | |
| 7,438,199 | B1 | 10/2008 | Tidrick | |
| 2007/0068947 | A1 | 3/2007 | Rush | |

* cited by examiner

*Primary Examiner* — Anthony Stashick
*Assistant Examiner* — Andrew T Kirsch
(74) *Attorney, Agent, or Firm* — Edward P. Li

(57) ABSTRACT

A vacuum release device for assisting removal of plastic bags from containers is disclosed. The device is a channel made from non-porous materials. The channel has multiple segments and is capable of being attached to both the sidewall and the bottom wall of a container. As the channel is attached to the walls of the container, an air conduit is formed to provide air conduction in the container. The attachment methods comprises mechanical, chemical, and adhesive. The channel has openings at the container's bottom wall and at the corner between the container's sidewall and bottom wall. The unique structure of the channel protects the openings from being blocked by a plastic liner.

9 Claims, 5 Drawing Sheets

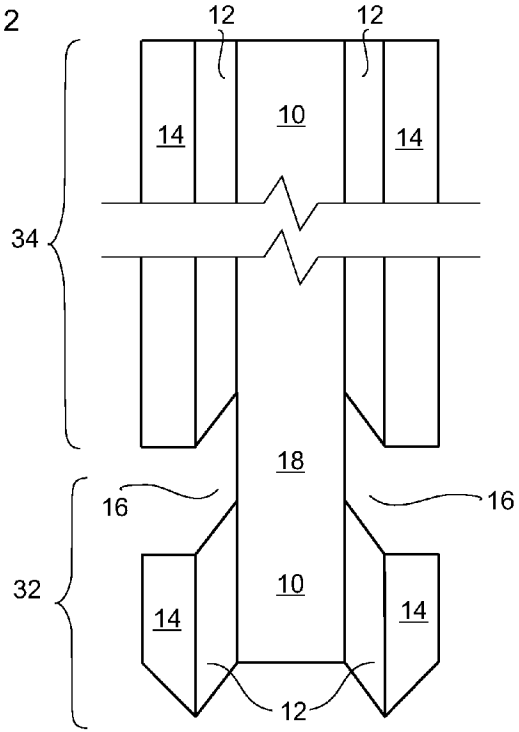
FIG. 2
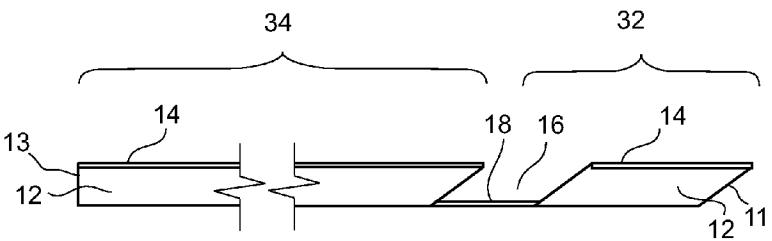
FIG. 3
FIG. 4

VACUUM RELEASE DEVICE FOR ASSISTING REMOVAL OF PLASTIC BAGS FROM CONTAINERS

BACKGROUND OF THE INVENTION

1. Field of the Invention

The present invention relates to a vacuum release device for assisting removal of plastic bags from containers.

2. Related Art

Removal of plastic bags from containers (e.g. removal of plastic liners from trash cans) is difficult due to vacuum conditions inside the containers. The vacuum conditions are created between the plastic bags and walls of the containers when the plastic bags are placed into the containers and filled. The vacuum conditions may cause rupture of the plastic bags when the filled bags are lifted from the containers. It is desired that the vacuum conditions in the containers can be eliminated or prevented.

In U.S. Pat. No. 4,294,379 (Bard, 1981), a trash receptacle with molded or attached hollow tubes is presented. In U.S. Pat. No. 5,170,906 (Kocheleck, 1992), a trash can with spaced vertical ribs on sidewalls is disclosed. In U.S. Pat. No. 5,375,732 (Bowers, et al., 1994), a garbage container including an air conduit molded in the sidewall is disclosed. U.S. Pat. No. 6,015,063 (Poliquin, 2000) discloses a trash can vent system, in which a vent assembly is positioned along the interior sidewall and attached on the can by a secure cap. U.S. Pat. No. 6,474,495 B1 (Frei, 2002) discloses a garbage can with apertures around both the open and closed ends of the can. In U.S. Pat. No. 6,594,876 B1 (Stastny, 2003), a method for modifying an existing trash can is disclosed. As described in this disclosure, one end of an air conduit is extruded outside of the trash can and tied onto the trash can, and the other end placed on the bottom of the trash can. U.S. Pat. No. 6,736,281 B2 (Joseph, 2004) provides a waste receptacle including air baffles formed on the inner sidewalls and the bottom wall of the receptacle. US Pat. Pub. No. 2007/0068947 A1 (Rush, 2007) discloses a molded half-moon-shaped air tube capable of being bonded to a trash can with a self-adhesive tape. U.S. Pat. No. 7,438,199 (Tidrick, 2008) discloses a vacuum release trash container. The sidewall of the vacuum release trash container has open columns between an inner wall and an outer wall. Vacuum release orifices, in communication with the columns, are made on the top rim and on the inner wall near the bottom of the container.

In summary, there are primarily two categories of methods for vacuum release in trash containers. In the first category, improvements of containers are proposed. The improvements include an air conduit built into sidewalls (U.S. Pat. Nos. 5,375,732 and 7,438,199), air baffles or vertical ribs built on inside surfaces of sidewalls (U.S. Pat. Nos. 5,170,906, 6,736,281 B2), and apertures made on sidewalls (U.S. Pat. No. 6,474,495 B1). These improvements have following disadvantages. (1) Complexity and cost of manufacturing these improved containers will increase. (2) These improvements can not solve the problem of vacuum release in currently used containers.

In the second category, methods of adding vent channels or air conduits on existing containers are developed. These methods are presented in four disclosures, U.S. Pat. Nos. 4,294,379, 6,015,063, and 6,594,876 B1, and US Pat. Pub. No. 2007/0068947 A1. Some disadvantages of these methods are as follows. In U.S. Pat. Nos. 4,294,379 and 6,015,063, and US Pat. Pub. No. 2007/0068947, the vent channels or the air conduits are only capable of being positioned along sidewalls in the containers. Because of the structures of the vent channels or the air conduits, it is impossible to position one assembly of the vent channels or the air conduits continuously along both the sidewall and the bottom wall in the containers. In U.S. Pat. No. 6,594,876 B1, an air conduit is positioned on the bottom of a container, but the air conduit has only one opening at the end of the air conduit on the bottom; therefore, the air conduit can not prevent vacuum in most contacting areas between a plastic trash liner and walls of the container. In U.S. Pat. Nos. 6,594,876 B1 and 6,015,063, one of advantages is that the air conduits or the vent channels are extruded outside of the containers. The most significant disadvantage in the four disclosures is that, due to structures of openings in the air conduits or the vent channels, plastic liners can easily block the openings. The blockage will consequently render the air conduits or the vent channels ineffective in preventing or eliminating vacuum in the containers.

SUMMARY

An object of this present invention is to provide a vacuum release device for assisting plastic bags from containers.

This invented vacuum release device is a channel with multiple segments. The channel is manufactured from non-porous materials. Two adjacent segments of the channel can be longitudinally angled to each other at a predetermined angle. Due to this structural flexibility, a single unit of the channel is capable of being attached to the sidewall and bottom wall in a container. The attachment methods comprises mechanical, chemical, and adhesive. As the channel is attached to the walls of the container, an air conduit is formed to provide air conduction in the container. The channel has openings at the container's bottom and at the inner corner between container's sidewall and bottom; therefore, air conduction in the container is enhanced. Furthermore, the unique structure of the channel protects the openings from being blocked by a plastic liner.

The vacuum release device in this present invention has many advantages over others. The advantages are as follows. (1) The structural flexibility of the channel allows air conduits to be easily constructed on both the sidewall and the bottom wall of containers. (2) The channel's function of preventing or eliminating vacuum in containers is enhanced because openings of air conduits are situated at the bottom and at the corner between the sidewall and the bottom wall of containers. (3) The unique structure of the channel protects openings of air conduits from being blocked and thereby improves air conduction in containers. (4) Manufacture of this invented device is economical and simple. (5) Installation of this invented device in containers is easy.

BRIEF DESCRIPTION OF THE DRAWINGS

FIG. 2 is a top view of the exemplary channel in FIG. 1. In this top view, the open top of the channel faces upward.

FIG. 3 is a front view of the exemplary channel in FIG. 1.

FIG. 4 is a left side view of the exemplary channel in FIG. 1.

DETAILED DESCRIPTION OF THE DRAWINGS

Figure 1:
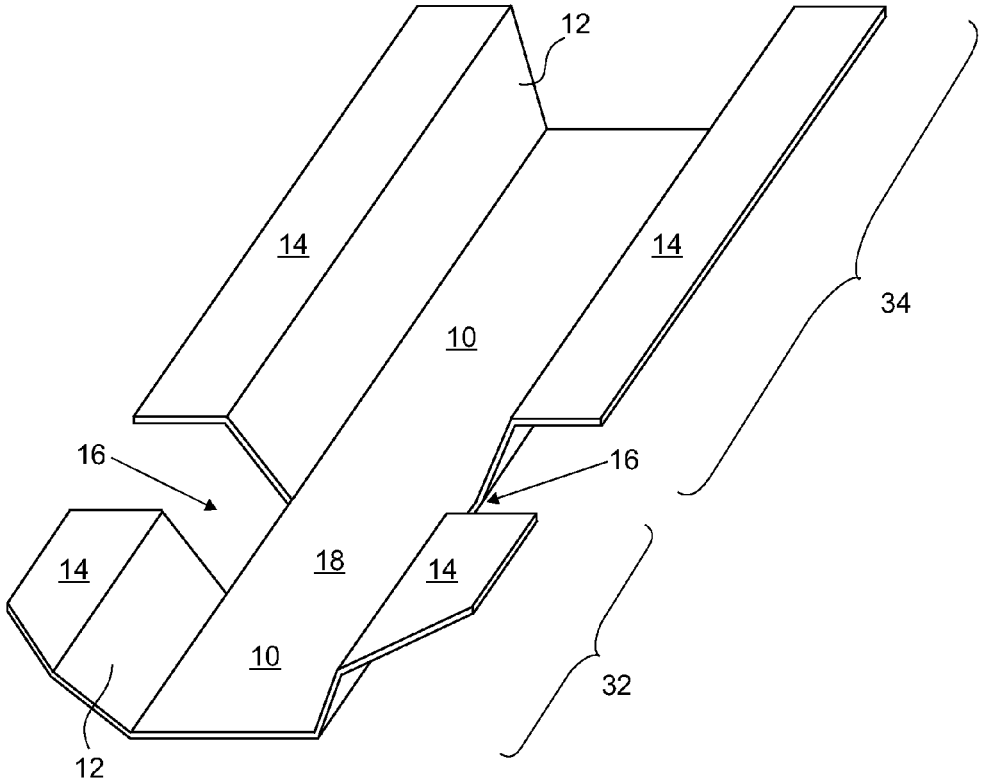
FIG. 1 is a perspective view showing an exemplary embodiment of the channel with two segments.

FIG. 1 presents a perspective view showing an exemplary embodiment of the channel with two segments 32 and 34. FIGS. 2-4 show respectively the top, front, and left side views of the exemplary embodiment in FIG. 1. The channel comprises an elongated base wall 10 which has a bendable portion 18 between the segments 32 and 34. Each of the segments 32 and 34 has two elongated sidewalls 12 and an open top. The bendable portion 18 is devoid of the sidewalls. In the exemplary embodiment, the cross section of the channel is a trapezoid. In other embodiments, the cross section can be a rectangle or a square. The channel has two longitudinal open ends 11 and 13. At the open end 11 in the segment 32, the inner angle between the plane of the open end 11 and the base wall 10 is obtuse. At the open end 13 in the segment 34, the angle between the plane of the open end 13 and the base wall 10 is substantially 90 degrees. The sidewalls 12 connect to the base wall 10 along respective longitudinal edges thereof and projects upward. The top edges of the sidewalls 12 define the open top of the channel. The open top is substantially parallel to the base wall 10. Each of the segments 32 and 34 has two elongated flanges 14. The flanges 14 connect to respective sidewalls 12 along the top edges thereof and projects outward in reference to the channel. In other embodiments, the flanges can project inward in reference to the channel. The segments 32 and 34 connect to each other by a bendable portion 18 of the base wall 10. The bendable portion 18 is capable of being longitudinally bent at a predetermined angle. Therefore, the segments 32 and 34 are capable of being longitudinally angled to each other at a predetermined angle.

Figure 5:
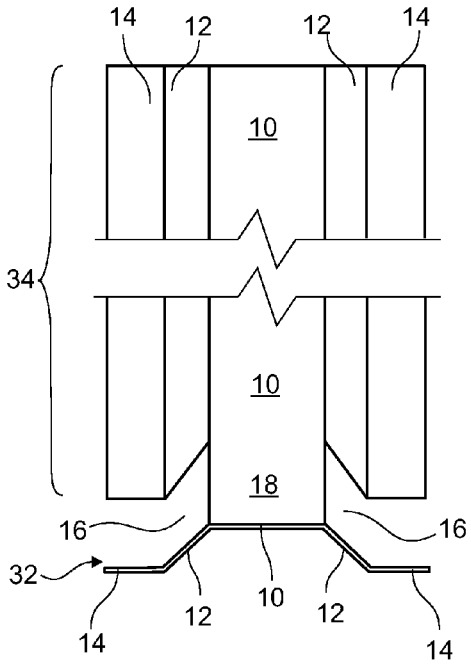
FIG. 5 is a front view showing an exemplary embodiment of two segments angled at 90 degrees to each other.
Figure 6:
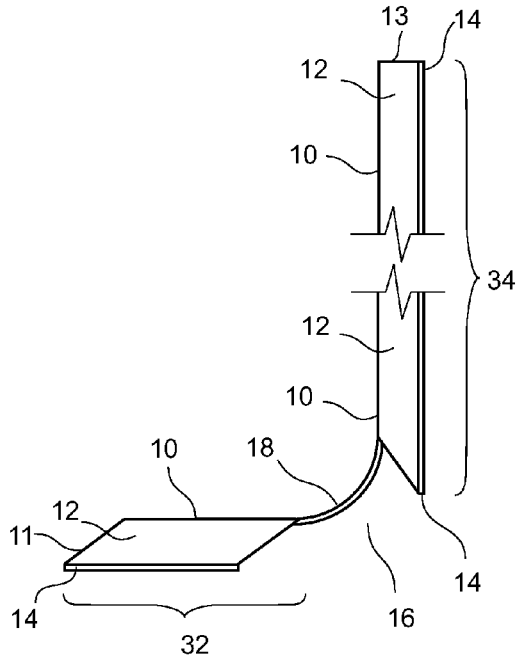
FIG. 6 is a right side view corresponding to FIG. 5.
Figure 7:
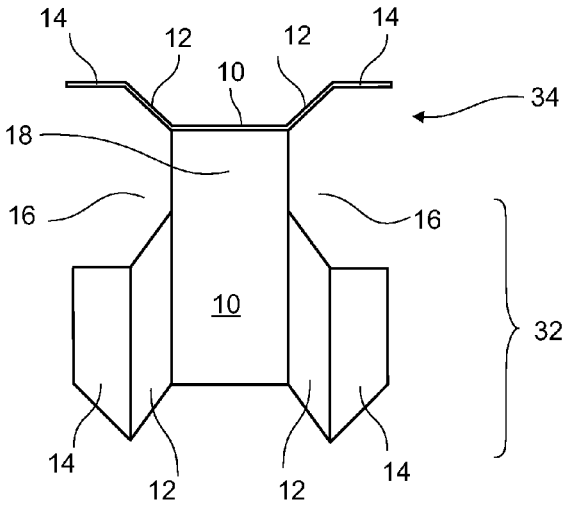
FIG. 7 is a top view corresponding to FIG. 5.

FIGS. 5-7 present respectively the front, right side, and top views showing an exemplary embodiment of the angled segments. In the exemplary embodiment, the segments 32 and 34 angled at 90 degrees to each other. In the FIGS. 5-7, the segment 34 is positioned vertically and the open top of the segment 34 is oriented sideward; the segment 32 is positioned horizontally and the open top of the segment 32 is oriented downward. As the open top of the segment 32 faces down, the plane of the open end 11 in the segment 32 faces slant upward. The bendable portion 18 of the base wall 10 connects the angled segments 32 and 34.

Figure 8:
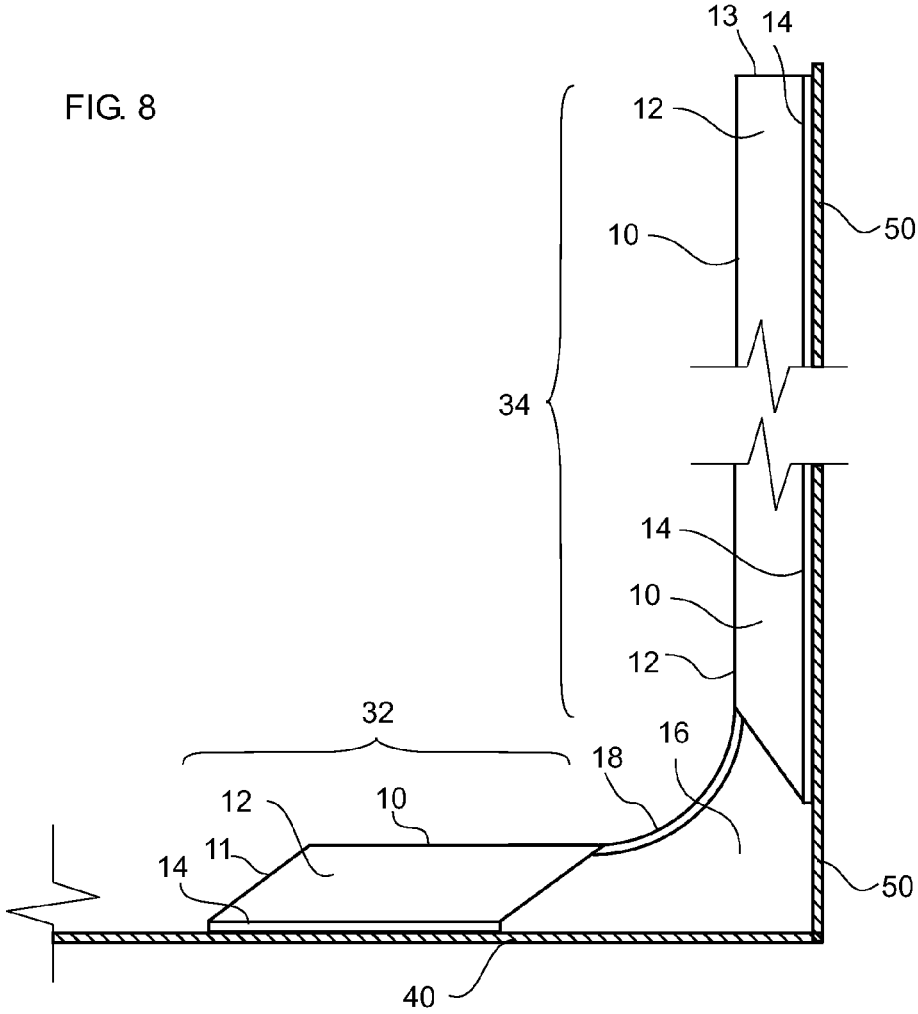
FIG. 8 is a schematic showing the exemplary channel with two segments attached on container's sidewall and bottom.

The channel can be used to construct an air conduit in a container. Referring to FIG. 8, the channel is affixed on the container by attachment of the flanges 14 to the container's walls 40 and 50. The attachment methods comprises mechanical, chemical, and adhesive. As the flanges 14 are attached to the container's walls, the open top of segment 32 faces the interior surface of the container's bottom wall 40, and the open top of the segment 34 faces the interior surface of the container's sidewall 50. The combination of the base wall 10, the sidewalls 12, and the container's walls 40 and 50 forms the air conduit inside the container. The angle between the flange's plane and the sidewall's plane is adjustable, and therefore the flanges 14 are capable of being attached to various walls of the container. The segments 32 and 34 are capable of being longitudinally angled to each other. Due to this structural flexibility of the channel, a single unit of the channel with the segment 32 and 34 is capable of forming the air conduit on two angled surfaces, i.e. the container's sidewall and bottom. In this exemplary embodiment, the segment 32 is attached to the container's bottom 40 and the segment 34 to the container's sidewall 50. Therefore, the air conduit is formed on both the container's sidewall 50 and bottom 40. The length of the segment 34 is adjusted so that the open end 13 of the channel can be positioned proximal to the mouth of the container. The open end 11 of the channel in segment 32 is positioned on the bottom of the container, and the plane of the open end 11 on the bottom of the container faces slant upward. The open end 11 in the segment 32 provides air conduction on the container's bottom 40. The openings 16 of the channel are located at the inner corner between the container's sidewall 50 and bottom 40, whereby air conduction is provided at the inner corner. The openings 16 are below the or bendable portion 18 of the base wall 10, whereby the bendable portion 18 prevents the openings 16 from being blocked by a plastic liner.

Figure 9:
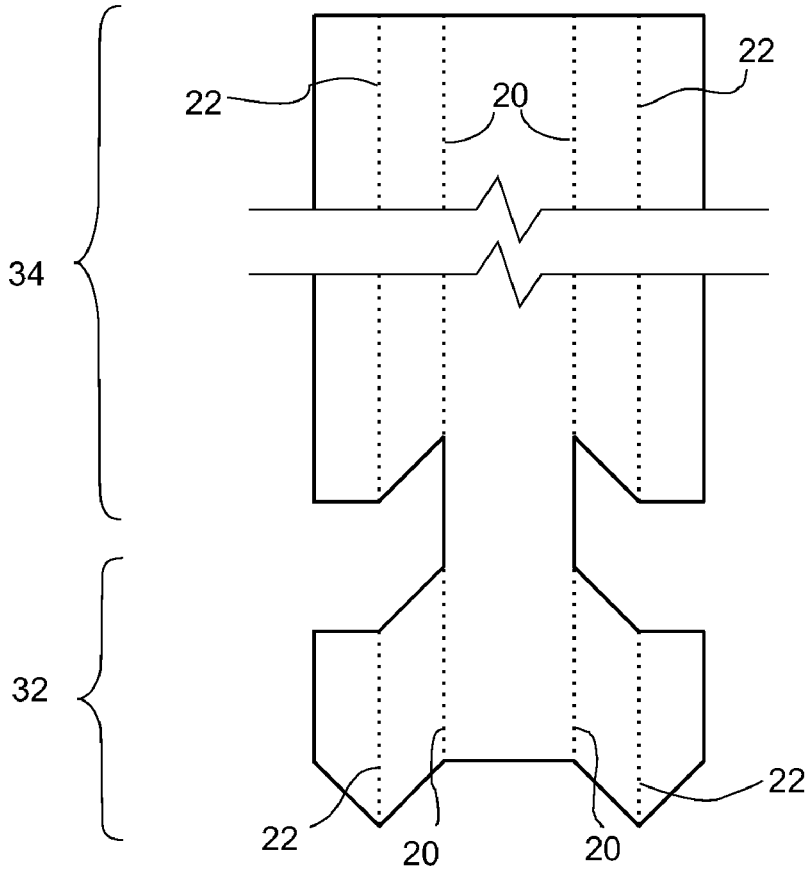
FIG. 9 is a plan view showing a material sheet for making the exemplary embodiment of the channel with two segments in FIG. 1.

The exemplary embodiment of the channel with two segments is made from a single piece of non-porous material. FIG. 9 illustrates a sheet of the material. The sheet is longitudinally divided into two segments 32 and 34. The sheet is folded along lines 20 and 22.

What is claimed is:

1. A vacuum release device capable of constructing an air conduit on walls of a container, said device comprising:

two longitudinal segments of an open channel;

said open channel comprising an elongated base wall, said elongated base wall having a bendable portion between said two longitudinal segments;

each of said two longitudinal segments comprising two elongated sidewalls connecting to respective longitudinal edges of said base wall and projecting upward, an open top defined by top edges of said sidewalls and substantially parallel to said base wall, and two elongated flanges longitudinally along respective said top edges of said two elongated sidewalls;

said bendable portion devoid of said sidewalls;

wherein said bendable portion is so bent that said two longitudinal segments are longitudinally angled to each other at a predetermined angle, said two longitudinal segments are installed inside said container, said open top of a first segment of said two longitudinal segments faces a container sidewall, said open top of a second segment of said two longitudinal segments faces a container bottom wall, said flanges of said first segment are attached on said container sidewall, said flanges of said second segment are attached on said container bottom wall, said bendable portion is situated at an inner corner between said container sidewall and said container bottom wall, such that said open channel forms said air conduit on both said container sidewall and said container bottom wall;

wherein said bendable portion covers a void space at said inner corner and forms two openings of said air conduit at said inner corner, so as to provide air conduction at said inner corner; and wherein a first longitudinal open end of said air conduit is located inside said container and on said container bottom wall, and a second longitudinal open end of said air conduit is located inside said container and proximal to a container mouth.

2. The vacuum release device of claim 1 wherein the inner angle between the plane of said first longitudinal open ends and said base wall is obtuse while the inner angle between the plane of said second longitudinal open ends and said base wall is a substantially right angle.

3. The vacuum release device of claim 1 wherein angles between said flanges and said sidewalls are adjustable.

4. The vacuum release device of claim 1 wherein said flanges project outward in reference to said open channel.

5. The vacuum release device of claim 1 wherein a cross section of said open channel is a trapezoid.

6. The vacuum release device of claim 1 wherein a cross section of said open channel is a rectangle.

7. The vacuum release device of claim 1 wherein a cross section of said open channel is a square.

8. The vacuum release device of claim 1 wherein the longitudinal length of each of said two longitudinal segments is adjustable.

9. The vacuum release device of claim 1 wherein said open channel is made from a nonporous material.

* * * * *